US009545559B2

(12) United States Patent
Romashev et al.

(10) Patent No.: US 9,545,559 B2
(45) Date of Patent: Jan. 17, 2017

(54) SYSTEM FOR JETTISONING SNOWBOARD IN AN EMERGENCY SITUATION

(71) Applicants: Dmitrii Aleksandrovich Romashev, Moscow (RU); Dmitrii Vladimirovich Gavva, Moscow (RU)

(72) Inventors: Dmitry Alexandrovich Romashev, Moscow (RU); Dmitry Vladimirovich Gavva, Moscow (RU)

( * ) Notice: Subject to any disclaimer, the term of this patent is extended or adjusted under 35 U.S.C. 154(b) by 53 days.

(21) Appl. No.: 14/781,256

(22) PCT Filed: May 21, 2013

(86) PCT No.: PCT/RU2013/000417
§ 371 (c)(1),
(2) Date: Feb. 17, 2016

(87) PCT Pub. No.: WO2014/163526
PCT Pub. Date: Oct. 9, 2014

(65) Prior Publication Data

US 2016/0158634 A1 Jun. 9, 2016

(30) Foreign Application Priority Data

Apr. 5, 2013 (RU) ..... 2013115275

(51) Int. Cl.

| | |
|---|---|
| ***A63C 10/06*** | (2012.01) |
| ***A63C 10/12*** | (2012.01) |
| ***A63C 10/28*** | (2012.01) |
| ***A41D 13/015*** | (2006.01) |

(52) U.S. Cl.
CPC ..... *A63C 10/12* (2013.01); *A41D 13/015* (2013.01); *A63C 10/06* (2013.01); *A63C 10/28* (2013.01); *A63C 2203/22* (2013.01)

(58) Field of Classification Search
CPC ..... A63C 9/08–9/0885; A63C 10/12
See application file for complete search history.

(56) References Cited

U.S. PATENT DOCUMENTS

| | | | | | |
|---|---|---|---|---|---|
| 3,919,563 | A * | 11/1975 | Lautier | ..... | A63C 9/0802 280/612 |
| 4,121,854 | A * | 10/1978 | Cornu | ..... | A63C 9/0802 280/612 |
| 4,371,188 | A * | 2/1983 | Hull | ..... | A63C 9/0802 280/613 |
| 4,494,768 | A * | 1/1985 | Hull | ..... | A63C 9/0802 280/612 |

(Continued)

*Primary Examiner* — Erez Gurari
(74) *Attorney, Agent, or Firm* — Inventa Capital PLC

(57) ABSTRACT

The invention relates to the systems for ensuring the safety of an individual, particularly in case of avalanche or other emergencies when snowboarding. The system for jettisoning a snowboard consists of a signaling device comprising a wireless transmitting module, a contact connected to an initiating lever, current source and equipment release modules. Each equipment release module which is arranged on a corresponding strap (rear strap, or on each of the straps) of the snowboard binding consists of the wireless receiving module, a replaceable pyrotechnic element and a current source. Each replaceable pyrotechnical element is an integral part of the strap (rear strap) of the snowboard binding, the latter constituting a plastic band which consists of two parts and is connected by a rod according to the swivel hinge principle.

10 Claims, 2 Drawing Sheets

(56) References Cited

U.S. PATENT DOCUMENTS

| | | | | |
|---|---|---|---|---|
| 6,659,494 | B1 * | 12/2003 | Martin | A63C 9/0802 280/612 |
| 6,675,692 | B1 * | 1/2004 | Goetz | B60R 21/13 102/202.1 |
| 7,073,812 | B2 * | 7/2006 | Rigal | A63C 9/0802 280/611 |
| 7,815,213 | B2 * | 10/2010 | Damiani | A63C 9/088 280/611 |
| 7,841,614 | B2 * | 11/2010 | Damiani | A63C 9/088 280/611 |
| 2009/0243259 | A1 * | 10/2009 | De La Torre Rodriguez | A63C 9/0802 280/618 |
| 2011/0018233 | A1 * | 1/2011 | Senner | A63C 9/0802 280/623 |
| 2016/0158634 | A1 * | 6/2016 | Romashev | A63C 10/12 280/809 |

* cited by examiner

SYSTEM FOR JETTISONING SNOWBOARD IN AN EMERGENCY SITUATION

The invention relates to the systems for ensuring the safety of an individual where necessary, in particular in case of avalanche or other emergencies when riding on a sport equipment such as a snowboard (hereinafter referred to as snowboard).

BACKGROUND OF THE INVENTION

The closest to the technical substance of the claimed invention is a system to release bindings of ski boots or snowboard boots which consists of a signaling device comprising a wireless transmitting module, a contact connected to the handle of initiation, a current source and equipment release modules disclosed in Document EP 1941935 A2 published on Jul. 9, 2008.

The disadvantage of this system is a high probability of accidental actuation of the system as well as the failure of its components due to the design features. Moreover, an engineering problem of releasing binding elements has not been solved for analog equipment and there exists the risk of losing the signalling mechanism.

SUMMARY OF THE INVENTION

An engineering challenge of the claimed invention is to create a system for jettisoning snowboard in an emergency situation which provides the required operational efficiency and reliability of both the system as a whole and its elements.

The "snowboard jettisoning" for the purpose of this patent application means disengagement of a sportsman (snowboarder) of a snowboard as a result of release, undoing or disruption of the snowboard binding elements which leads to a mechanical separation of the snowboarder's legs from the sports equipment.

The nature of invention lies in that fact that the system for jettisoning snowboard consists of a signaling (trigger) device comprising a wireless transmitting module, an electric contact connected to the handle of initiation (handle of actuation), a current source; as well as the equipment release modules. For the purposes of the present patent "contact" means a device which provides a surface contact of electrically conductive materials.

For optimal performance the system for jettisoning snowboard has the following design features: each equipment release module, which is located on the corresponding binding belt (rear strap) of the snowboard binding, consists of a wireless receiving module, a replaceable pyrotechnic element and a current source. Each replaceable pyrotechnic element is an integral part of the belt (rear strap) of the snowboard binding, which consists of a two-piece plastic (plastics, polymer) strap connected by a rod according to the swivel hinge principle. It is also possible to arrange the replaceable pyrotechnic element on all snowboard binding straps (one for each snowboard binding strap). For the purposes of the present patent application the "rear strap" means the strap located closer to the snowboarder's heel.

The foregoing features of the claimed invention ensure the technical effect which lies in the ability to provide the required operational efficiency and reliability of both the system as a whole and its elements due to the use of wireless transmitting and receiving modules, as well as the new design equipment release modules.

In the particular case of execution of the system for jettisoning snowboard: each equipment release module may be enclosed in a water-repelling case provided with the pressure relief and vibration dampers.

In the particular case of execution of the system for jettisoning snowboard: the signaling device and/or each equipment release module include an on/off switch for the wireless module.

In the particular case of execution of the system for jettisoning snowboard: the wireless transmitting and receiving modules are connected either wirelessly via Bluetooth or Wi-Fi communication protocols, or they are transmitting and receiving modules operating in accordance with other wireless communication standards which are not mentioned above and capable to maintain specified temperature, humidity and impact protection requirements.

In the particular case of execution of the system for jettisoning snowboard: the signaling device is located on the items of the snowboarder's (the person operating a snowboard) clothing.

In the particular case of execution of the system for jettisoning snowboard: the signaling device is located on the snowboarder's equipment.

In the particular case of execution of the system for jettisoning snowboard: the signaling device and equipment release modules additionally comprise light bulbs or light-emitting diodes signaling of the charging strength (measure, rate or level) of the current source.

In the particular case of execution of the system for jettisoning snowboard: the signaling device is located on the avalanche protection backpack having the handle of actuation.

In the particular case of execution of the system for jettisoning snowboard: the handle of initiation for the signaling device is connected with the handle of actuation of the avalanche protection backpack.

DESCRIPTION OF THE DRAWINGS

The invention is illustrated by drawings representing the following.

DETAILED DESCRIPTION OF THE INVENTION

Figure 1:
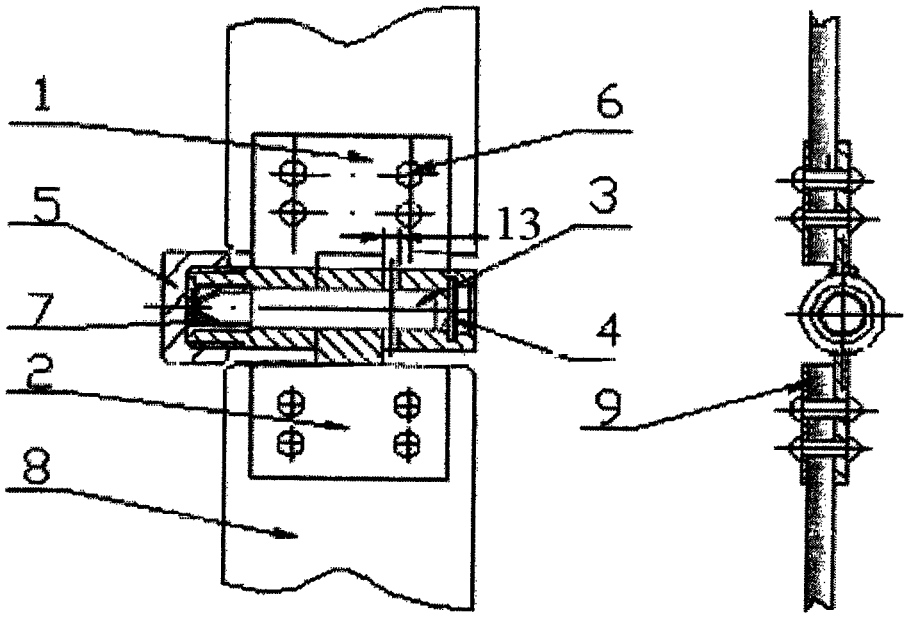
FIG. 1 illustrates a release link mechanism.
Figure 2:
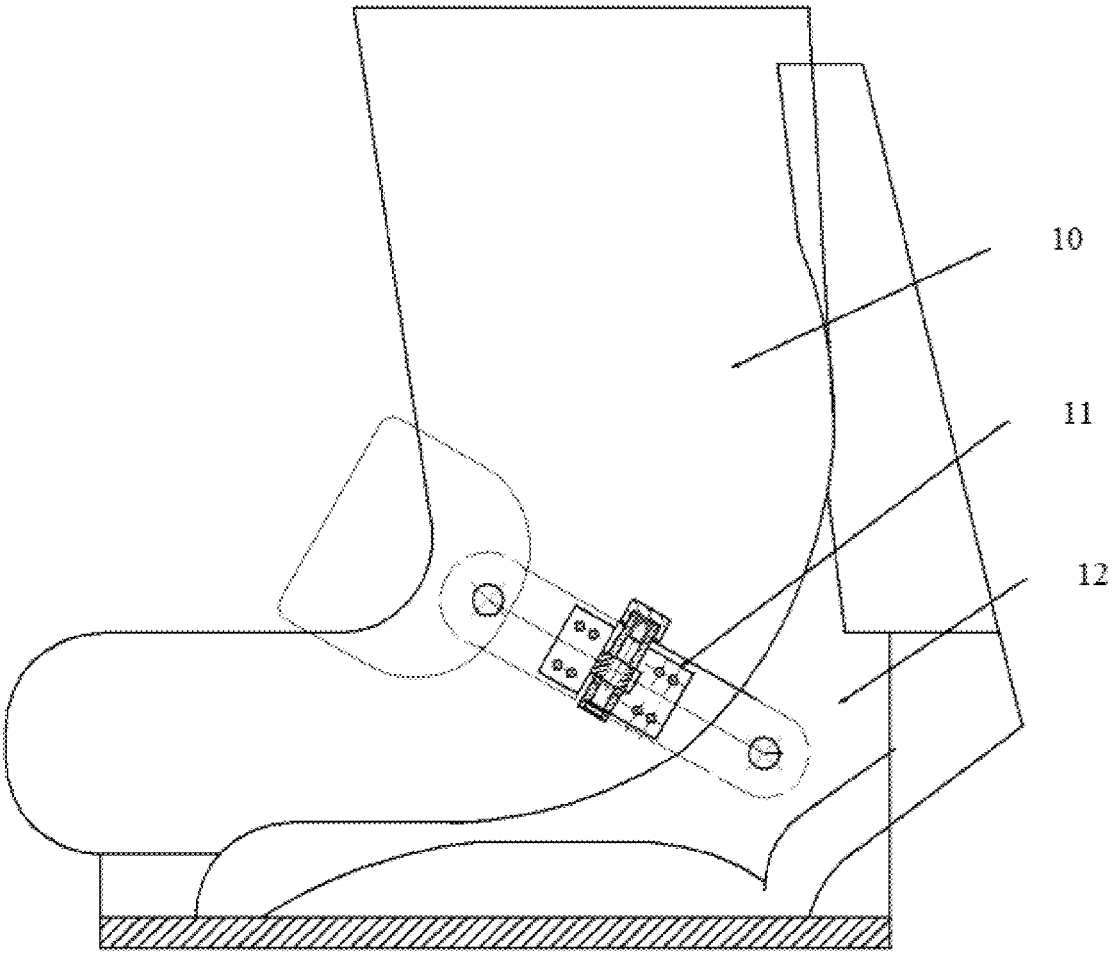
FIG. 2 illustrates a belt (rear strap) of the snowboard binding with the installed release mechanism.

The system for jettisoning snowboard comprises a signaling device comprising a wireless transmitting module, a contact connected to the handle of initiation, a current source and equipment release modules. Each equipment release module which is located on the corresponding belt (rear strap) of the snowboard binding consists of the wireless receiving module, replaceable pyrotechnic element and a current source. Each replaceable pyrotechnic element is an integral part of the belt (rear strap) of the snowboard binding which is a two-piece plastic strap connected by the rod according to the swivel hinge principle.

The release link mechanism 11 executed on the swivel hinge principle consists of the link mechanism 1 and 2, connected by the rod 3, protection membrane 4 and the pyrotechnic element 7, fixed by a coupling nut 5.

The release link mechanism 11 is mounted on two parts of the notched belt (upper strap) 8 of the boot 10 binding 12 and fixed with the help of the pad 9 and rivets 6. The release mechanism is actuated as follows:

In an emergency, concurrently with activation of the handle of initiation, the wireless transmitting module sends a signal to wireless receiving modules which actuate the pyrotechnic element 7. The detonation of the pyrotechnic element 7 causes overpressure which acts upon the flat end of the rod 3 moving it towards the protection membrane 4. On reaching the area 13 of holes, 2 mm in diameter each, the pressure is released into the atmosphere and the rod 3 sharply slows down its movement. On reaching the area of holes 13 by the rod 3, the link mechanism under the belt tension force (upper strap) 8 becomes disengaged releasing the boot from the snowboard binding.

Each equipment release module may be enclosed in a water-repelling case provided with dampers which allows to enhance the life cycle of the equipment release modules. The signaling module and/or each module to release equipment may additionally comprise the module activation switch which enables to protect from undesirable involuntary actuation and to save the current source charge as well. The wireless transmitting and receiving modules may be either of Bluetooth or Wi-Fi type, or infrared transmitting and receiving modules, or transmitting and receiving modules operating in accordance with other wireless communication standards capable to maintain specified temperature, humidity and impact protection requirements which enables to enhance the life cycle of the modules.

The signaling device may be located either on the items of the snowboarder's clothing or on the snowboarder's equipment which enables to place the signaling module on a snowboarder-friendly item of clothing or equipment, including the backpack. Signaling device and equipment release modules additionally comprise light bulbs or light-emitting diodes indicating the status of the current source charge which enables timely to replace the current source in case of failure. The signaling device may be located on the avalanche protection backpack having the handle of activation in which case the handle of initiation for the signaling device may be connected with the handle of activation for the avalanche protection backpack which in the event of an avalanche will provide the required efficient response of the life-saving equipment.

The claimed technical decision enables to accomplish an urgent, quickest possible jettisoning of the snowboard which can not be carried out in the ordinary course, when a snowboarder is caught by avalanche or in any other situation where one has to initiate the emergency jettisoning of the snowboard.

Thus, the claimed technical decision fully complies with the stated objective. The accomplished analysis of the present technology including the retrieval of patent and scientific-and-engineering information, identification of data sources containing information on analogues of the claimed technical decision revealed that the Applicant did not discover the sources characterized by features identical to all essential features of the claimed invention. Consequently, the claimed technical decision meets the requirement of patentability.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A system for jettisoning a snowboard including a signaling (start-up) device, said system including:

a wireless transmitting module, a contact connected to an initiating lever and a current source, and equipment release modules, each equipment release module located on the corresponding belt (rear strap) of a snowboard binding including a wireless receiving module, replaceable pyrotechnic element and a current source, wherein each replaceable pyrotechnic element is an integral part of the belt (rear strap) of the snowboard binding, presenting a plastic band including two parts and connected by a rod moving in swivel hinge fashion.

2. The system as set forth in claim 1, wherein each equipment release module is enclosed in a water-repelling case with dampers.

3. The system as set forth in claim 1, wherein the signaling (start-up) device and/or each equipment release module includes the module activation switch.

4. The system as set forth in claim 1, wherein the wireless transmitting and receiving modules are connected either wirelessly via Bluetooth or Wi-Fi communication modules, transmitting and receiving modules operating in accordance with other wireless communication standards which are not mentioned above.

5. The system as set forth in claim 1, wherein the signaling (start-up) device is located on the items of clothing of the snowboarder.

6. The system as set forth in claim 1, wherein the signaling (start-up) device is located on the equipment the snowboarder.

7. The system as set forth in claim 1, wherein signaling device and equipment release modules additionally comprise light bulbs or light-emitting diodes indicating the level of the current source charge.

8. The system as set forth in claim 1, wherein signaling (start-up) device is located on an avalanche protection backpack having a handle of activation.

9. The system as set forth in claim 1, wherein a replaceable pyrotechnic element is an integral part of other belts of each snowboard binding other than the rear strap.

10. The system as set forth in claim 8, wherein the handle of initiation for the signaling (start-up) device is connected with the handle of activation for the avalanche protection backpack.

* * * * *